US006206262B1

(12) United States Patent
Achelpohl et al.

(10) Patent No.: US 6,206,262 B1
(45) **Date of Patent: *Mar. 27, 2001**

(54) SEPARATING DEVICE FOR SEVERING PERFORATED TUBE SECTIONS

(75) Inventors: Fritz Achelpohl, Lienen; Richard Feldkamper; Friedhelm Brinkmeier, both of Lengerich; Ulrich Eckelt, Tecklenburg, all of (DE)

(73) Assignee: WindMöller & Hölscher, Lengerich/Westf (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/897,102

(22) Filed: Jul. 18, 1997

Related U.S. Application Data

(63) Continuation of application No. 08/547,829, filed on Oct. 25, 1995, now abandoned.

(30) Foreign Application Priority Data

Nov. 14, 1994 (DE) ..... 44 40 660

(51) Int. Cl.[7] ..... B26F 3/02
(52) U.S. Cl. ..... 225/100; 225/4
(58) Field of Search ..... 225/2, 3, 4, 100, 225/101, 102, 103, 104, 105, 106; 198/626.3, 626.5, 592, 861.5, 835; 493/287, 302, 340, 344, 369

(56) References Cited

U.S. PATENT DOCUMENTS

| | | | | |
|---|---|---|---|---|
| Re. 27,043 | * | 1/1971 | Hausman et al. | 225/103 X |
| 2,285,814 | * | 6/1942 | Hill | 225/103 X |
| 2,988,254 | * | 6/1961 | Fulger | 225/103 X |
| 3,057,527 | * | 10/1962 | Hannon | 225/100 |
| 3,120,915 | * | 2/1964 | Horn et al. | 225/103 X |
| 3,122,292 | * | 2/1964 | Ford et al. | 225/105 X |
| 3,562,061 | * | 2/1971 | Maidment | 225/101 X |
| 3,568,488 | * | 3/1971 | Franks | 225/101 X |
| 3,730,411 | * | 5/1973 | Brockmuller | 225/100 |
| 3,779,367 | * | 12/1973 | Hope et al. | 198/592 X |
| 4,131,272 | * | 12/1978 | Hartnig | 225/100 X |
| 4,397,410 | * | 8/1983 | Schueler | 225/100 X |
| 4,493,684 | * | 1/1985 | Bolton | 225/100 X |
| 4,498,894 | * | 2/1985 | Kuckhermann | 225/100 X |
| 5,079,982 | * | 1/1992 | Antonissen | 198/625.5 X |
| 5,388,746 | * | 2/1995 | Hatchell et al. | 225/100 |
| 5,480,083 | | 1/1996 | Achelpohl . | |

FOREIGN PATENT DOCUMENTS

| | | | |
|---|---|---|---|
| 491004 | | 7/1970 | (CH) . |
| 4113792A1 | | 10/1992 | (DE) . |
| 4134834A1 | | 12/1992 | (DE) . |
| 0008900 | * | 1/1977 | (JP) ..... 198/625.5 |

OTHER PUBLICATIONS

IBM Technical Disclosure Bulletin, vol. 16 No. 6 (Nov. 1973) *Document Burster* by Amundson et al.*

* cited by examiner

*Primary Examiner*—Boyer Ashley
(74) *Attorney, Agent, or Firm*—Evenson, McKeown, Edwards & Lenahan, P.L.L.C.

(57) ABSTRACT

A separating device for severing perforated tube sections includes an advancing mechanism and a tearing mechanism which respectively include opposing rollers or cylinders which are situated on both sides of the tubular web to be separated and over which endless transport bands are guided. The rollers or cylinders of the tearing mechanism can be moved in the direction toward the tubular web by a control element. The opposing rollers or cylinders in the tearing mechanism are respectively situated in swivel arms that are arranged such that they swivel around swiveling axes that oppose one another in the transport direction of the tubular web and the swivel arms swivel apart in opposite directions.

6 Claims, 5 Drawing Sheets

SEPARATING DEVICE FOR SEVERING PERFORATED TUBE SECTIONS

This is a continuation application of Ser. No. 08/547,829, filed on Oct. 25, 1995, now abandoned.

FIELD OF THE INVENTION

The invention pertains to a separating device for severing perforated tube sections.

BACKGROUND OF THE INVENTION

A separating device of this type is, for example, disclosed in DE 4,113,792 A1. In this known separating device, a tubular web is transported at a certain advance speed by the advancing mechanism. During this advance motion, the tubular web passes through a tearing mechanism that is arranged behind the advancing mechanism viewed in the transport direction, namely such that the rolls or cylinders of the tearing mechanism or the bands that are guided over said rollers or cylinders come in contact with the tubular web. If it is intended to separate a tubular web into tubular web sections by tearing the tubular web along a perforation that extends perpendicular to the longitudinal direction of the tubular web, the rolls or cylinders of the tearing mechanism are moved against the tubular web and driven at a higher circumferential speed than the rolls or cylinders of the advancing mechanism in order to tear off the tubular sections. During this tearing process, a tensile force is exerted upon the entire following web due to this differential speed. This tension also acts upon the advancing mechanism as long as the perforations are not separated. In the aforementioned separating device, the opposing rollers or cylinders of the advancing mechanism are arranged offset to one another. Consequently, the tubular web extends between these rollers or cylinders in the shape of a serpentine. However, practical experience has shown that the pressing force that is exerted upon the tubular web via the bands that extend around the rollers or cylinders does not suffice for retaining the tubular web once the tearing mechanism is engaged and—as described previously—exerts a tensile force upon the following tubular web. This causes an undesirable slippage that influences the tearing process unfavorably and can also lead to striations because the web slides along the bands.

DE 4,243,105 A1 discloses another separating device developed for severing perforated tube sections in which the rollers or cylinders that are arranged underneath the tubular web to be separated in the tearing mechanism as well as in the advancing mechanism are pressed against the tubular web in a synchronized fashion so as to tear off the perforated tube sections. In this case, the rollers or cylinders are respectively moved back and forth in a translational fashion, namely in a direction that extends perpendicular to the tubular web. However, the constructive realization of this separating device is comparatively complicated due to the translational guidance of the rollers or cylinders.

SUMMARY OF THE INVENTION

The invention is based on the objective of further designing a separating device of the initially mentioned type in such a way that said separating device has a simple design and allows the safe and undamaged separation of tube sections from a perforated tubular web.

According to the invention, this objective is attained by arranging the opposing rollers or cylinders of the tearing mechanism in respective swivel arms that can be swiveled around swiveling axes that oppose one another in the transport direction of the tubular film in such a way that the swivel arms can be swiveled apart in opposite directions. This simple measure makes it possible that the opposing rollers or cylinders can simultaneously come in contact with the tubular web when tearing off a perforated section. In this case, it is not necessary to guide an entire set of rollers or cylinders in a translational fashion. On the contrary, only a swiveling motion that is comparatively simple to implement is required. This particularly simple solution is possible because the swiveling motions of the swivel arms that carry the rollers or cylinders extend in the same direction.

According to one advantageous embodiment of the invention, a connecting rod is coupled with one of the swivel arms arranged on top of the transport plane of the tubular web and a pressure rod is coupled with one of the swivel arms arranged underneath the transport plane of the tubular web. A lever and a cam plate act upon the connecting rod and the pressure rod in such a way that the swivel arms can be swiveled toward one another as well as apart from one another around their respective swiveling axis.

In another embodiment, the rollers or cylinders of the opposing rollers or cylinders which are arranged on top of the transport plane of the tubular web are situated on shafts that are rigidly connected with the bearing shield. However, the rollers or cylinders arranged underneath the transport plane of the tubular web are situated on shafts that are connected with plates which are movably guided in the bearing shields, with a piston-cylinder unit engaging on one swiveling point of the movable plates. One roller or cylinder is situated on a shaft that is rigidly connected with the plates while two rollers or cylinders are situated on shafts that are arranged in a rocker that is suspended in the plates in a swiveling fashion. This arrangement of the rollers or cylinders makes it possible for all three rollers or cylinders which are situated adjacent to one another simultaneously to come into contact with the opposite rollers or cylinders when they are actuated by the piston-cylinder unit because any unevenness is immediately compensated by the swiveling motion around the respective swiveling points.

According to one additional advantageous embodiment of the invention, movement that controls the connecting rod or the pressure rod of the tearing mechanism is also transferred onto the movable rollers or cylinders of the advancing mechanism by means of an arrangement of rods, with these rods preferably engaging on one side of the rocker. A push rod of these transfer rods can be coupled with the additional components of the rods by means of a spring. This measure prevents the roller or cylinder upon which the rods act from being abruptly pressed against the tubular web because a spring-dampened movement of the roller or cylinder against the opposite roller or cylinder is attained.

The bearing shields of the tearing mechanism and the advancing mechanism which are arranged on top of the transport plane of the tubular web can also be arranged in such a way that they can be swiveled around an axis, with the swiveling axis coinciding with the rotation axis of those deflection rollers for the conveyor band which lie toward the rear viewed in the transport direction of the tubular web. This pivoting apart in a direction that extends opposite to the transport direction makes it possible to pivot the conveyor belts that lie on top of the transport plane apart if a foreign object, e.g., a screwdriver or the like, is transported between these belts. The aforementioned pivoting apart prevents the destruction of the adjoining rollers or cylinders.

The conveyor belts of the tearing mechanism and the retaining mechanism can, in particular in the latter described embodiment of the invention, be driven by means of a mechanically driven toothed belt. In this case, the toothed belt is guided over toothed pulleys that are arranged in a rotationally rigid fashion on shafts of deflection rollers, with the toothed pulleys situated on top of the tubular web being arranged on the axis around which the bearing shields can be swiveled.

BRIEF DESCRIPTION OF THE DRAWINGS

Additional details and advantages of the invention are described in detail below with reference to two embodiments that are illustrated in the figures. The figures show.

DETAILED DESCRIPTION OF THE PREFERRED EMBODIMENTS

Figure 1:
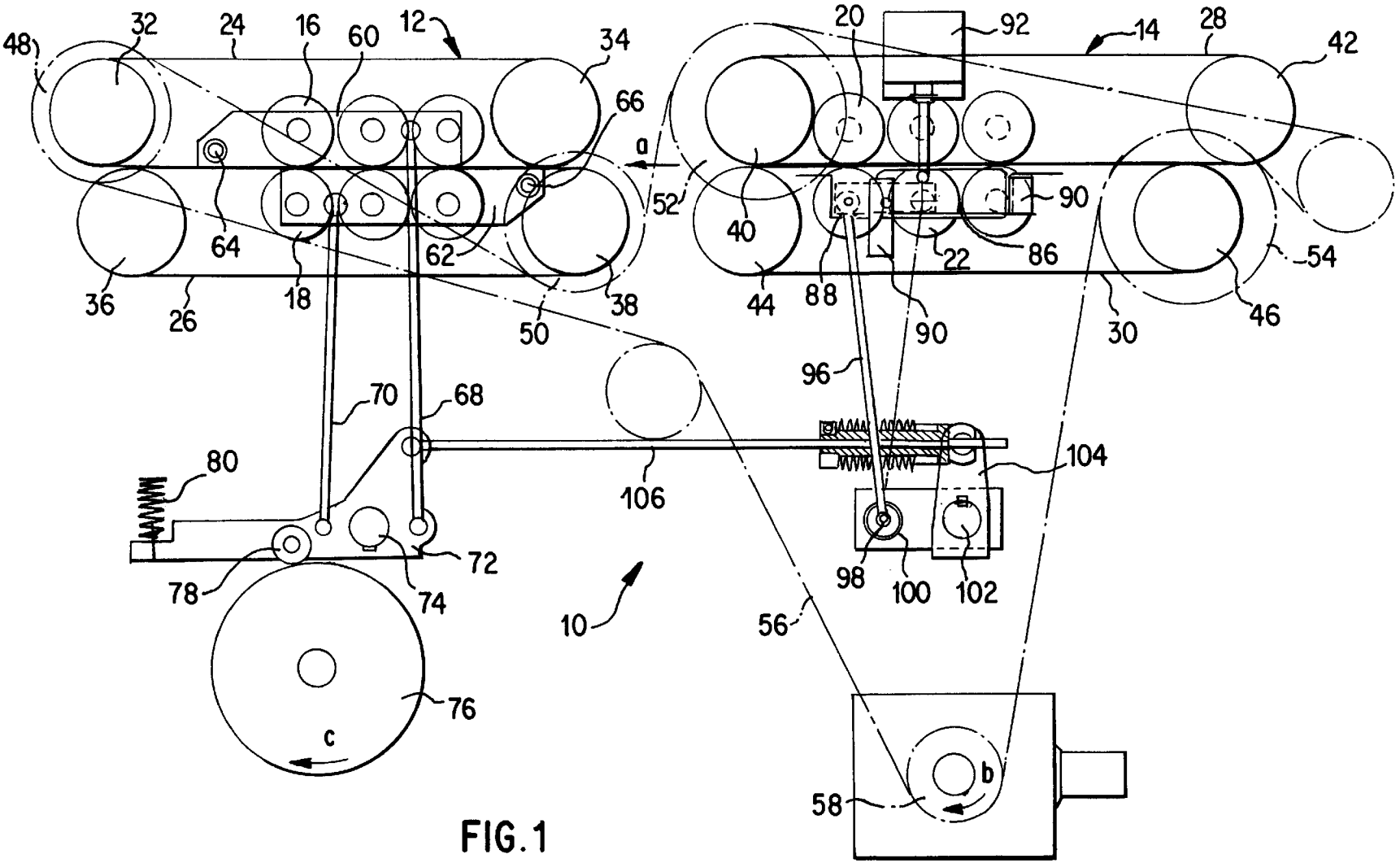
FIG. 1: a schematic side view of one embodiment of the separating device according to the invention.

A separating device 10 for severing perforated tube sections from a tubular web consists of a tearing mechanism 12 and an advancing mechanism 14. The tearing mechanism 12 is arranged behind the advancing mechanism 14 viewed in the transport direction (arrow a) as shown in FIG. 1.

The tearing mechanism 12 and the advancing mechanism respectively comprise rollers or cylinders 16, 18 or 20, 22 that are arranged on both sides of the tubular web. Conveyor belts 24, 26 or 28, 30 are guided over the aforementioned rollers or cylinders in customary fashion. Conveyor belt 24 is guided around deflection rollers 32 and 34, conveyor belt 26 is guided around deflection rollers 36 and 38, conveyor belt 28 is guided around deflection rollers 40 and 42, and conveyor belts 30 is guided around deflection rollers 44 and 46. The respective deflection rollers 32, 34, 36, 38, 40, 42, 44, 46 are arranged in a rotatable fashion in bearing shields that are not illustrated in detail in FIG. 1. The respective conveyor belts 24, 26, 28 and 30 are driven by means of a toothed belt 56 that is moved in the direction of the arrow b by means of a drive 58. The toothed belt 56 extends over a toothed pulley 48 that is arranged on the shaft of the deflection roller 32, subsequently over a toothed pulley 50 that is arranged on the axle of the deflection roller 38, then over a toothed pulley 52 that is arranged on the shaft of the deflection roller 40 and ultimately over a toothed pulley 54 that is fastened onto the shaft of the deflection roller 46. The progression of the toothed belt 56 is illustrated in the form of a broken line in FIG. 1.

In the tearing mechanism 12, the rollers or cylinders 16 or the rollers or cylinders 18 are respectively arranged laterally in swivel arms 60, 62. The swivel arm 60 can be swiveled around an axis 64 and the swivel arm 62 can be swiveled around an axis 66, with both of the aforementioned axes being arranged rigidly with respect to the bearing shields. The swiveling axis 64 is, referred to the transport direction (arrow a), arranged behind the rollers or cylinders 16. However, the swiveling axis 66 is arranged in front of the rollers or cylinders 18 referred to the transport direction (direction of the arrow a). This means that the swivel arms are moved toward one another or apart from one another in opposite directions. This pivoting motion in opposite directions makes it possible to realize the contact between the rollers or cylinders 16 and 18 simultaneously.

The swiveling motion of the swivel arms 60 or 62 is implemented by means of a connecting rod 68 that engages on the swivel arm 60 and a pressure rod 70 that engages on the swivel arm 62. The connecting rod 68 and the pressure rod 70 are respectively coupled with a lever 72, namely on opposite sides of a shaft 74 that carries the lever 72. The lever is actuated by means of a roll 78, namely over a cam plate 76 that is driven in the direction of the arrow c. In this case, the contact between the roll 78 and the cam plate 76 is ensured by a pressure spring 80 that engages on the free end of the lever 72. The swivel arms 60 or 62 and consequently the rollers or cylinders 16 or 18 can be moved toward one another as well as apart from one another by means of the cam plate. The rollers or cylinders are brought in contact with one another if it is intended to sever a perforated tube section.

Figure 2:
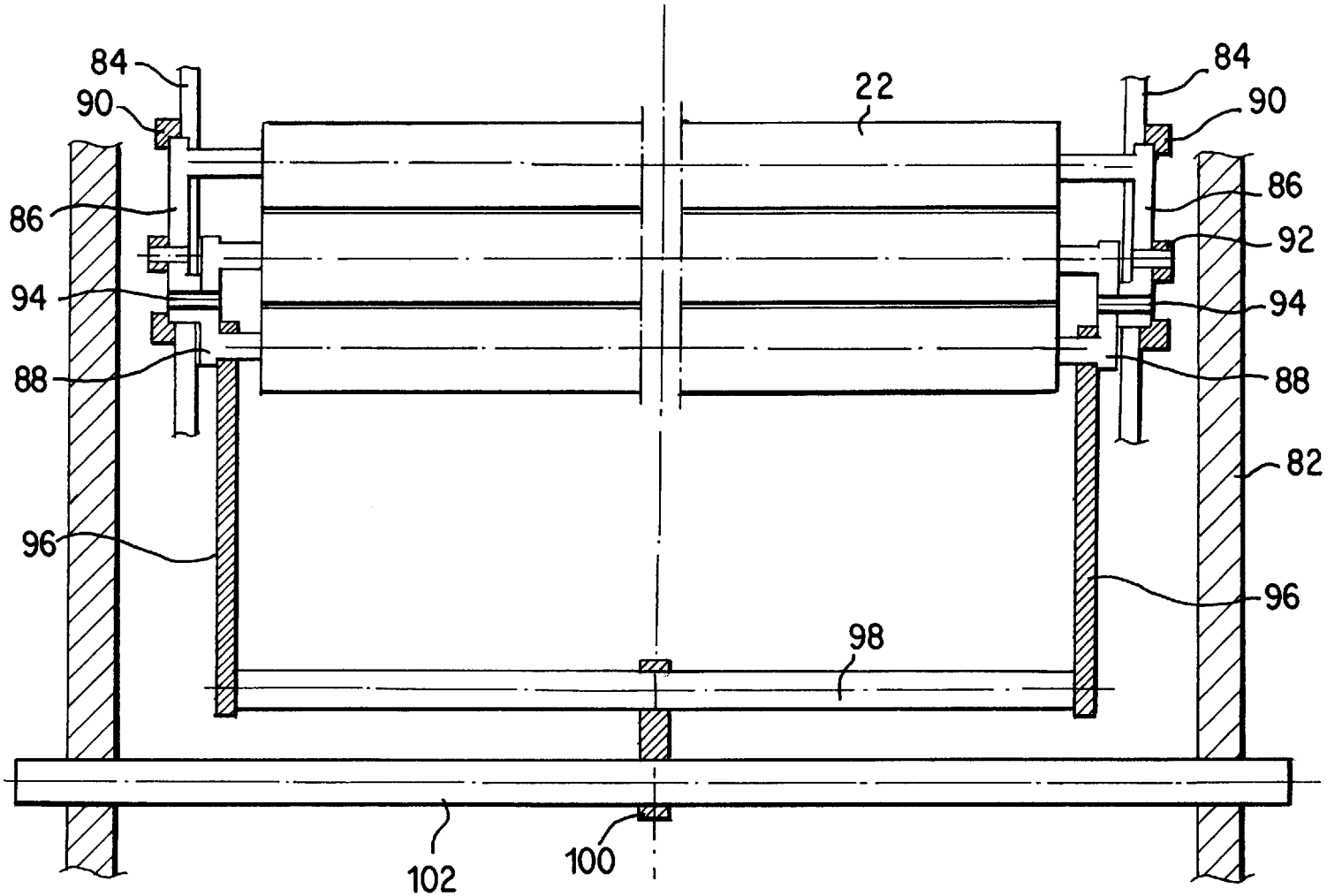
FIG. 2: a partial section through an advancing mechanism of a device according to the embodiment shown in FIG. 1, FIG. 3: a detail of the transfer rods according to the embodiment shown in FIG. 1, FIG. 4: a side view of a second embodiment of the present invention.

In the advancing mechanism 14, the rollers or cylinders 20 are arranged in the bearing shields that are not illustrated in detail in FIG. 1 over shafts that are rigidly connected with said bearing shields. However, the rollers 22 that are engaged with the rollers 20 are arranged in a movable fashion in the corresponding bearing shields. For an additional explanation of the arrangement of the rollers or cylinders 22, one can, in addition to FIG. 1, also refer to the sectional representation shown in FIG. 2. The reference numeral 84 in FIG. 2 identifies the bearing shields that are not illustrated in FIG. 1. Plates 86 are guided in a movable fashion in these bearing shields, namely in longitudinal guides 90. The plates 86 can be moved in the direction toward the transport plane over correspondingly coupled piston-cylinder units 92. The piston-cylinder units 92 are coupled with the plates 86 in a swiveling fashion as shown in FIG. 2. The rotation axis of one roller or cylinder 22 is arranged rigidly with respect to the plates 86 as shown in FIG. 2. The other two rollers or cylinders 22 are situated in a rocker 88 that is also arranged in the plates 86 such that it can be swiveled around bolts 94 (compare to FIG. 2). Due to this pendulum arrangement, the rollers or cylinders 22 are uniformly pressed against the rollers or cylinders 20 if the plates 86 are pulled in the direction of the transport plane of the tubular web over the piston-cylinder units 92. The rollers or cylinders 20 or 22 adjoin one another in order to advance the tubular web in the direction of the arrow a, i.e., a sufficiently high pressure is exerted upon the transport bands 28 and 30 so as to safely advance the tubular web that is not illustrated in detail in the figures. If it is intended to tear off one tubular section, i.e., once the rollers or cylinders 16, 18 of the tearing mechanism 12 engage with one another, the advancing mechanism 14 acts as a retention mechanism. In this case, an increased pressing force needs to be exerted at least upon the pair of rollers or cylinders 20, 22. For this purpose, a push rod 96 engages on a shaft of one roller or cylinder 22 situated in the rocker 88. The push rods 96 are connected with an arm 100 over a connecting shaft 98. The aforementioned arm is arranged in a shaft 102 in a rotationally rigid fashion, with the shaft being arranged in a lateral frame 82 of the entire device. An arm 104 that is coupled with the lever 72 over a push rod 106 is also connected with the shaft 102 in a rotationally rigid fashion. Consequently, the swiveling of the swivel arms 60 and 62 and the simultaneous swiveling of the rocker 88 can be attained by means of the cam plate 76 such that one of the rollers or cylinders 22 is pressed against one of the rollers or cylinders 20.

Figure 3:
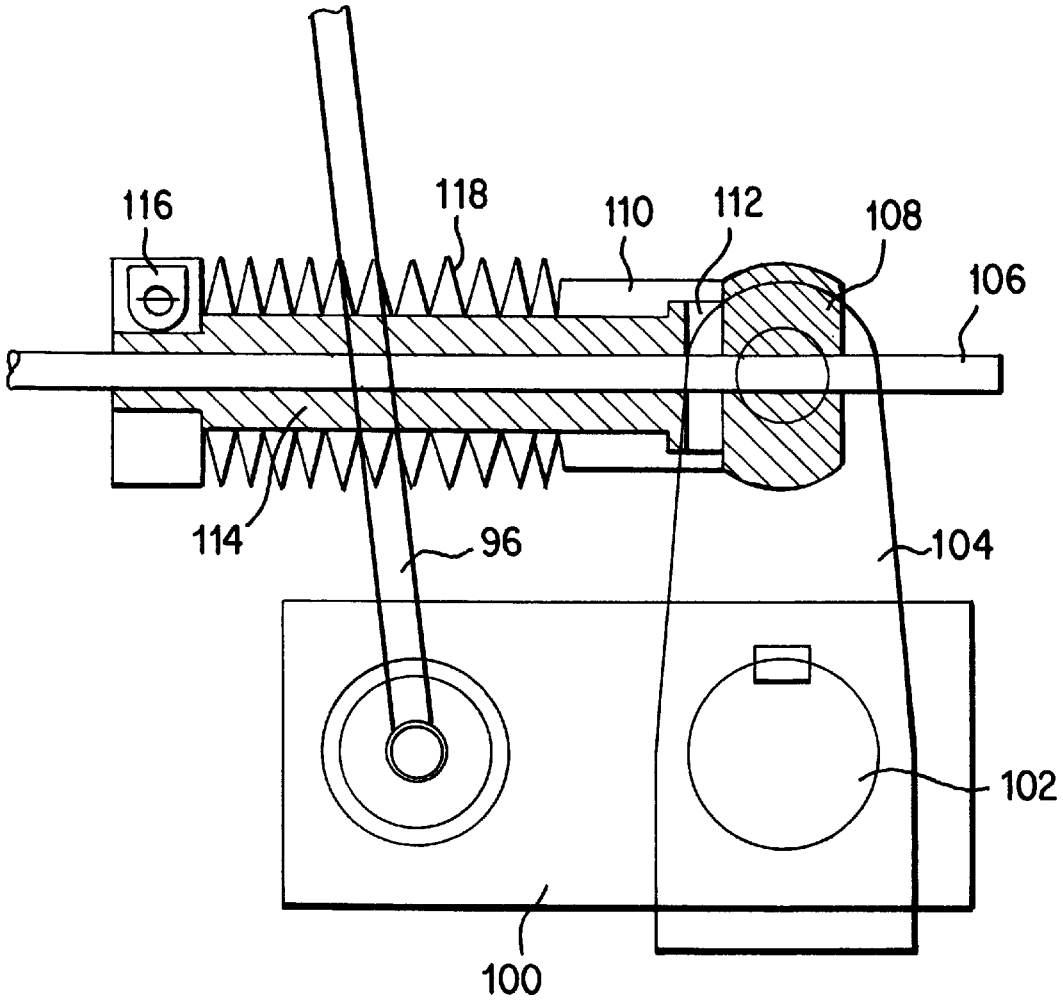

FIG. 3 shows an enlarged representation of part of the push rods 96 that are arranged in the arm 100 in a swiveling fashion. The arm 100 and the arm 104 are arranged on the shaft 102 in a rotationally rigid fashion. An articulated head 108 is arranged at the free end of the arm 104. This articulated head is adjoined by a sleeve 110 that is provided with an interior bore 112. A pipe 114 is arranged on the push rod 106. A clamping ring 116 is fastened onto one end of this pipe 114. In addition, a pressure spring 118 is arranged between the clamping ring 116 and the sleeve 110. FIG. 3 shows that the push rod 106 is braced against the spring 118 by means of the pipe 114 and the clamping ring 116, with said push rod being braced against the sleeve 110 and the articulated head 108 by means of the aforementioned spring. If the push rod 106 is displaced over the lever 72 shown in FIG. 1, the force is transmitted onto the sleeve by means of the spring 118 and subsequently onto the arm 104 by means of the articulated head such that the shaft 102 and consequently the arm 100 are swiveled. In this case, the spring 118 is dimensioned in such a way that it transmits the thrust in its entirety before it is compressed to such an extent that the pipe 114 is displaced up to the articulated head 108 inside of the bore 112. In this case, the normal stroke of the push rod 106 usually transferred amounts to approximately 3 mm.

Figure 4:
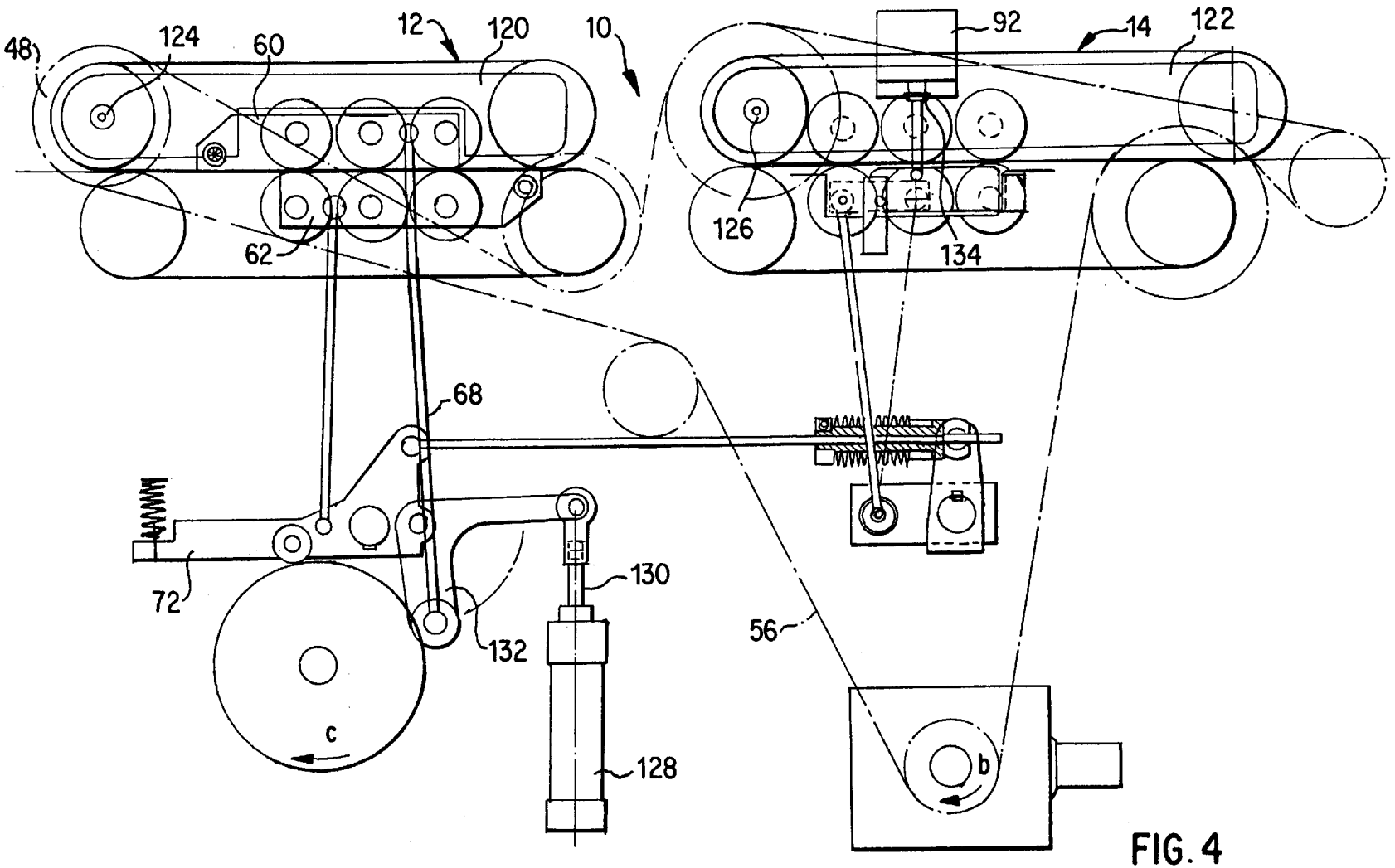
Figure 5:
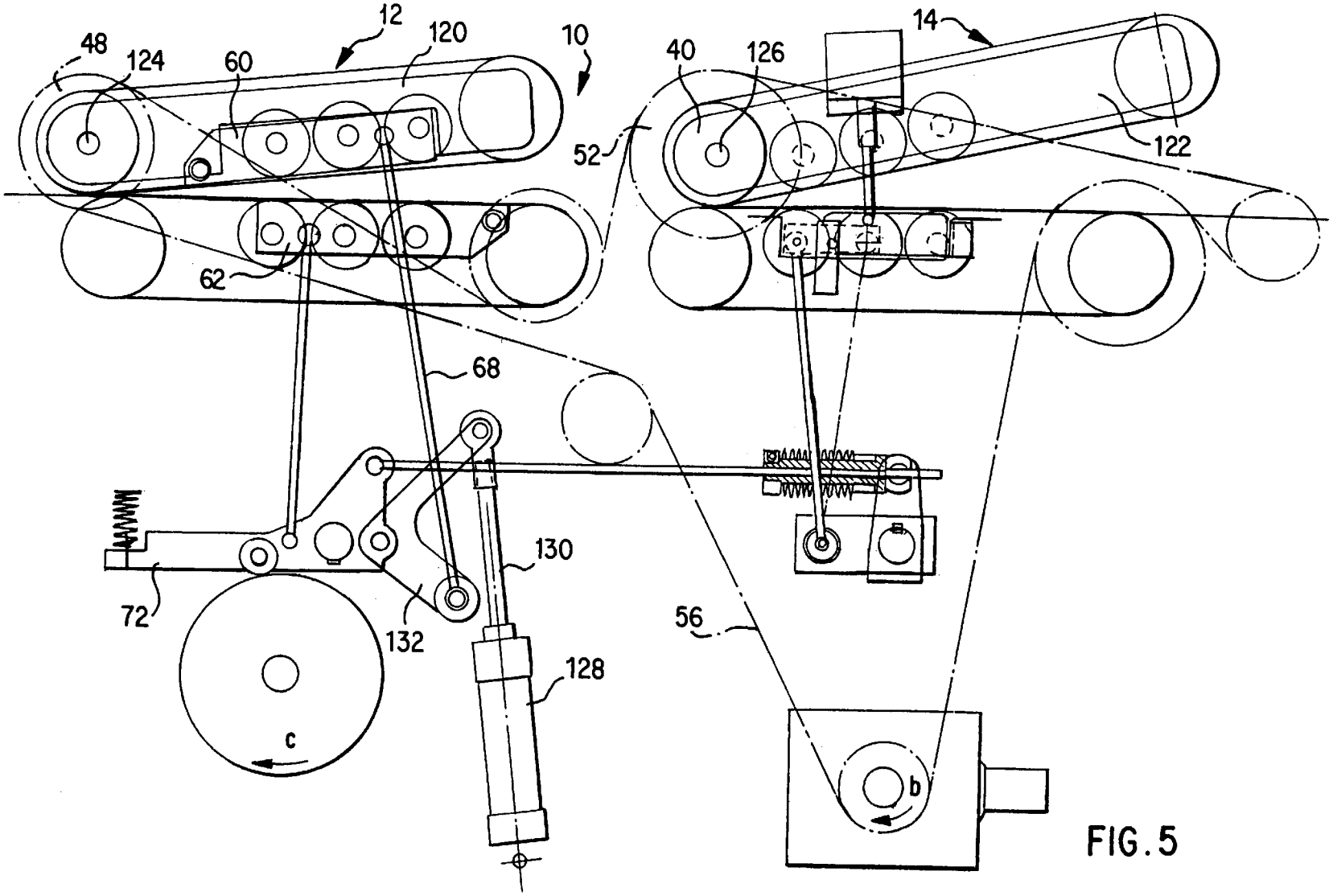
FIG. 5: a side view of the embodiment according to FIG. 4 in a different operating state.

FIGS. 4 and 5 show a modification of the embodiment shown in FIGS. 1–3. Components that function identically are not described anew with respect to their function, i.e., we refer to the previous description. In these figures, identical components are also identified by identical reference numerals.

The embodiments according to FIGS. 4 and 5 comprise an additional safety that causes a pivoting apart of the bearing shields 120 of the tearing mechanism 12 or the bearing shields 122 of the advancing mechanism 14 if a foreign object is transported between the conveyor belts 24, 26 or 28, 30. Such a foreign object can, for example, be a screwdriver that was accidentally left on the conveyor belt or any other object that can cause damage to the rollers and cylinders or deflection rollers if the bearing shields 120, 122 cannot be swiveled apart. In FIG. 4, the bearing shields 120 and 122 are illustrated in the non-swiveled position, with FIG. 5 illustrating the correspondingly swiveled position. The bearing shield 120 can be swiveled around the axis 124 and the bearing shield 122 can be swiveled around the axis 126. The axis 124 coincides with the axis of the deflection roller 32 and the toothed pulley 48, with the axis 126 coinciding with the axis of the deflection roller 40 and the axis of the toothed pulley 52. Due to this construction, the toothed belt 56 does not need to be removed when the bearing shields are swiveled apart as shown in FIG. 5.

It was already mentioned with reference to FIG. 1 that the swivel arm 60 is arranged in the bearing shield 120. In the modified embodiment shown in this figure, the connecting rod 68 that is coupled with the swivel arm 60 does not directly engage on the lever 72, but rather on an additional L-shaped lever 132 which, in turn, is coupled with the lever 72 in a swiveling fashion. The free end of the L-shaped lever 132 engages on a piston rod 130 that protrudes into a cylinder 128 which is rigidly connected with the lateral frame. In the customary operating position shown in FIG. 4, the piston rod 130 is pushed into the cylinder 128 that is rigidly connected with the lateral frame. If a solid object is transported between the conveyor belts 24 and 26, a force is exerted upon the rollers or cylinders 16 and 18, with the aforementioned force tending to spread apart the swivel arms 60 and 64. The swivel arm 60 adjoins the edge of the bearing shield 120 as shown in FIG. 5 such that a tensile force is exerted upon the connecting rod 68. This tensile force acts upon the piston rod 130 via the pivoted lever 132 and causes the piston rod 130 to be moved out of the cylinder such that the bearing shield 120 is swiveled apart around the swiveling axis 124 once a certain tensile force is exceeded.

The piston-cylinder unit in the advancing mechanism 14 is additionally connected with the bearing shield 122 at a coupling point 134. If a solid object exerts a corresponding force upon the rollers or cylinders 20 or 22, the piston-cylinder unit is moved apart in a similar fashion once a certain tensile force is exceeded, i.e., the bearing shield 122 is swiveled apart.

What is claimed is:

1. Separating device for separating perforated tube sections comprising:

an advancing mechanism which advances the tube sections in a transport direction, a tearing mechanism arranged downstream of the advancing mechanism in the transport direction and which receives the tube sections from the advancing mechanism, mutually opposite rollers in each of the advancing mechanism and the tearing mechanism on opposite sides of the tube sections to be separated, continuous conveyor belts running over said mutually opposite rollers, swivel arms in which the mutually opposite rollers in the tearing mechanism are disposed, each of the swivel arms swiveling in the same direction about a swivel pin which is situated at one end thereof such that the swivel arms swivel open away from each other and close toward each other, the rollers of the tearing mechanism simultaneously contacting one of the tube sections for tearing off the one of the tube sections when the swivel arms close toward each other, a connecting rod coupled with one of said swivel arms arranged above a transport plane of the tube sections, a pressure rod coupled with another of said swivel arms arranged below the transport plane of the tube sections, and a lever and a cam plate which act upon the connecting rod and the pressure rod so that the swivel arms are swivelled toward one another and apart from one another around the swivel pins.

2. Separating device according to claim 1, wherein control for at least one of the connecting rod and the pressure rod of the tearing mechanism is also transferred onto the rollers in the advancing mechanism by an arrangement of transfer rods.

3. Separating device according to claim 2, wherein the transfer rods include a push rod which is coupled with at least one other transfer rod by way of a spring.

4. Separating device according to claim 1, wherein rollers in the advancing mechanism arranged above the transport plane of the tube sections are arranged on shafts that are rigidly connected with bearing shields and rollers in the advancing mechanism arranged below the transport plane of the tube sections are arranged on shafts which are connected with movable plates, said movable plates being movably guided in said bearing shields, and further comprising piston-cylinder units which engage at one swiveling point of each of the movable plates, one roller being arranged on a shaft that is rigidly connected with the movable plates, and two rollers being arranged on shafts which are situated in swivelable rockers suspended in the plates.

5. Separating device according to claim 4, wherein the bearing shields of the tearing mechanism and the advancing mechanism which are situated above the transport plane of the tube sections are arranged for swiveling around a swiveling axis, the swiveling axis coinciding with a rotation axis of a deflection roller for one of the conveyor belts.

6. Separating device according to claim 5, wherein the conveyor belts of the tearing mechanism and the advancing mechanism are driven by a mechanically driven toothed belt, and wherein the toothed belt is guided over toothed pulleys that are arranged on the shafts of the deflection rollers in a rotationally rigid fashion.

* * * * *